US006907707B2

(12) United States Patent
Deiter

(10) Patent No.: US 6,907,707 B2
(45) Date of Patent: Jun. 21, 2005

(54) CONVERTED WOOD ARTICLE

(75) Inventor: Frank Deiter, Princeton (CA)

(73) Assignee: Synergy Wood Processing, Inc. (CA)

( * ) Notice: Subject to any disclaimer, the term of this patent is extended or adjusted under 35 U.S.C. 154(b) by 0 days.

(21) Appl. No.: 09/945,616

(22) Filed: Sep. 5, 2001

(65) Prior Publication Data

US 2002/0059775 A1 May 23, 2002

Related U.S. Application Data

(63) Continuation-in-part of application No. 09/250,166, filed on Feb. 16, 1999, now Pat. No. 6,286,287, which is a continuation-in-part of application No. 08/805,141, filed on Feb. 24, 1997, now Pat. No. 5,870,876.

(51) Int. Cl.[7] ..... E04C 3/30

(52) U.S. Cl. ..... 52/730.7; 52/726.2; 52/726.3; 52/726.4; 52/729.1; 52/729.4; 52/730.5; 52/731.1; 52/733.2; 52/736.1; 52/737.1; 52/737.6; 52/739.1

(58) Field of Search ..... 52/182, 726.1, 52/726.2, 726.3, 726.4, 729.1, 730.5, 731.1, 733.2, 736.1, 737.1, 737.6, 739.1, 730.7

(56) References Cited

U.S. PATENT DOCUMENTS

| | | | | | |
|---|---|---|---|---|---|
| 3,311,996 | A | * | 4/1967 | Bergener | |
| 4,394,409 | A | | 7/1983 | Hertel | |
| 4,794,749 | A | * | 1/1989 | Marcel | 52/611 |
| 5,299,400 | A | | 4/1994 | Sing | |
| RE35,327 | E | | 9/1996 | Sing | |
| 5,870,876 | A | * | 2/1999 | Deiter | 52/731.1 |
| RE36,153 | E | * | 3/1999 | Sing | 52/309.9 |
| 6,286,287 | B1 | * | 9/2001 | Dieter | 52/731.2 |

FOREIGN PATENT DOCUMENTS

| | | |
|---|---|---|
| DE | 964637 | 5/1957 |
| FR | 962589 | 6/1950 |
| FR | 2512729 | 3/1983 |

OTHER PUBLICATIONS

"Mustangworld Ramps", Mustangworld.com, pp. 1–6, Aug. 19, 2000.*

* cited by examiner

*Primary Examiner*—Carl D. Friedman
*Assistant Examiner*—Yvonne M. Horton
(74) *Attorney, Agent, or Firm*—Hall, Myers, Vande Sande & Pequignot

(57) ABSTRACT

A converted wood article for use in combination with other converted wood articles to form composite wood products for use in general construction such as in the construction of posts, flooring, walls and support beams.

28 Claims, 6 Drawing Sheets

CONVERTED WOOD ARTICLE

RELATED APPLICATION

This application is a continuation-in-part of U.S. patent application Ser. No. 09/250,166 filed Feb. 16, 1999, now U.S. Pat. No. 6,286,287 issued Sep. 11, 2001, which is a continuation-in-part of U.S. patent application Ser. No. 08/805,141 filed Feb. 24, 1997, now U.S. Pat. No. 5,870,876 issued Feb. 16, 1999.

FIELD

The present invention relates to converted wood articles and composite wood products made therefrom for use in general construction primarily but not limited to posts, flooring, walls and support beams, the posts and beams being both structural and non-structural, and a method for fabricating such articles and products.

BACKGROUND

The depletion of old growth forest has placed increasing demand within the forest industry for alternative wood products which make better use of old growth and stagnant growth timber and which also provide for greater use of second, third and later generation trees.

Several alternative wood products have emerged in an effort to address some of the needs in the industry. In this respect U.S. Pat. No. 4,394,409 discloses a composite wood product formed from four elongated triangular-shaped wood pieces. The four pieces are joined to form a composite wood product having a cross-sectional outline of a parallelogram and a hollow interior. An alternative embodiment is disclosed where each wood piece has a pair of machined keys to improve yield.

In U.S. Pat. No. 5,299,400 there is disclosed a composite wood product formed from four log parts, each log part having a three sided cross-section forming either right angled sectors and a third curved face or a right triangle. The log parts are assembled into a composite wood product so that their right angles form the corners of a rectangle with a hollow interior which is filled with concrete or other structural enhancing material. Similar examples of this alternative wood structure appear in U.S. Reissue 35,327 and French Patent No. 962589. Other attempts to offer improved composite wood products can be found in French Patent No. 2512729 and German Patent No. 964637.

While the composite wood products disclosed in the above mentioned references provide some improvements to the known art, there remains a continuing need for composite wood products providing additional resistance to shearing forces and impact forces, assembled from converted wood parts having a larger bonding surface and having a higher load bearing capacity without the preemptive need for the structural reinforcing material indicated in the prior art. Accordingly, it is an object of the invention to provide alternative converted wood articles for use in making composite wood products to fulfill the above needs in the art.

SUMMARY OF THE INVENTION

According to the invention there is provided a converted elongated wood article having a first planar face and a longitudinally extending face with rectangular steps whose step surfaces are parallel to a longitudinal extension of the article. A first set of the step surfaces are parallel to and a remaining second set of the step surfaces are perpendicular to the first planar face. The rectangular steps extend from the first planar face to a second planar face coinciding with a parallel one of the first step surfaces. A third face is oriented such that the first planar, the longitudinally extending, the second planar and the third faces form a triangular cross-section.

The third face may be a planar face at a right angle to the first planar face. Alternatively, the third face may be a longitudinally extending face having rectangular steps whose step surfaces are parallel to a longitudinal extension of the article and have a first set of step surfaces parallel to, and a second set of step surfaces perpendicular to, the first planar face. Preferably, planes passing through the extremities of the steps each form an equal angle with the longitudinally extending face.

The steps of a converted elongated wood article may have substantially similar or different dimensions. In one embodiment, the number of rectangular steps on a stepped face is three.

Further included within the scope of this invention is a method of fabricating a composite wood product by gluing together at least two converted elongated wood articles, each having a first planar face and a longitudinally extending face with rectangular steps having step surfaces parallel to a longitudinal extension of the converted elongated wood article. A first set of the step surfaces are parallel to and a second remaining set of the step surfaces are perpendicular to the first planar face. The steps extend to a second planar face coinciding with a parallel one of the first step surfaces. Each converted elongated wood article also has a third face oriented such that the first planar, the longitudinally extending, the second planar and the third faces form a triangular cross-section. The rectangular steps of one of the converted elongated wood articles are joined in mating abutment to the rectangular steps of another of the converted elongated wood articles forming a joint.

Further included within the scope of this invention is a method of fabricating a converted elongated wood article from a log. The converted elongated wood article is formed with a first planar face and a longitudinally extending face with rectangular steps whose step surfaces are parallel to a longitudinal extension of the converted elongated wood article. A first set of the step surfaces are parallel to, and a second set of the step surfaces are perpendicular to, the first planar face. A second planar face is formed parallel to the first planar face such that the second planar face and the steps are proximate a periphery of the log and the first planar face lies along a diameter of the log. A third face is also formed and oriented such that the first planar, the longitudinally extending, the second planar and the third face form a triangular cross-section. Preferably, the triangular cross-section of the log is such that at least two vertices of the triangular cross-section are outside the periphery of the log and the edges of at least two steps are on the periphery of the log.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAIL DESCRIPTION WITH REFERENCE TO THE DRAWINGS

Figure 1:
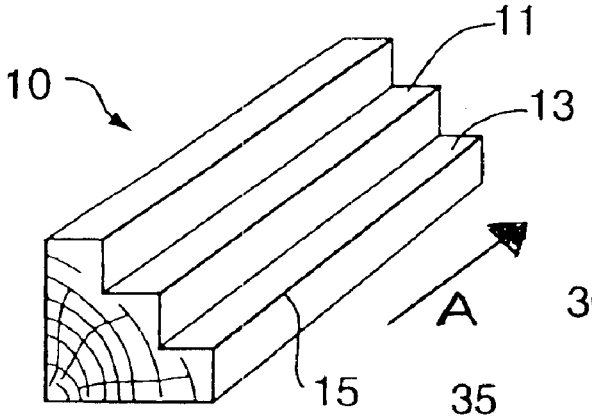
FIG. 1 is a perspective view of one converted elongated wood article having two planar faces and one stepped face.

Referring to FIG. 1, a converted elongated wood article 10 is formed according to the method set out below from a wood piece 11 and having rectangular steps 13 extending longitudinally in the direction of arrow A along stepped face 15.

Figure 2:
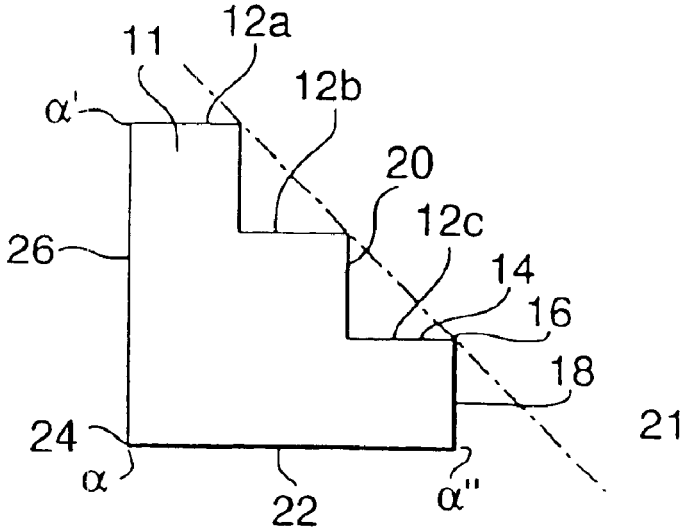
FIG. 2 is a cross-sectional view of a portion of the converted elongated wood article in FIG. 1.

Referring to FIG. 2, converted elongated wood article 10 having a triangular cross-section includes a first planar face 22 and a third planar face 26 and longitudinally extending stepped face 20. Planar faces 22 and 26 intersect at region 24 forming substantially right angle $\alpha$. Stepped face 20 intersects with planar face 22 and planar face 26 forming substantially right angles $\alpha'$ and $\alpha''$, respectively. Rectangular steps 12*a,* 12*b,* and 12*c* form the outline of stepped face 20. The rectangular steps 12*a,* 12*b,* and 12*c* are comprised of a first set of step surfaces 14 and a second set of step surfaces 18 intersecting at substantially right angle corner 16. In the embodiment illustrated, steps 12*a,* 12*b,* and 12*c* are dimensioned and oriented such that each corner 16 substantially lies along a notional straight line 21. A second planar face is defined as coincident with the first step surface 14 of rectangular step 12*a*.

Figure 3:
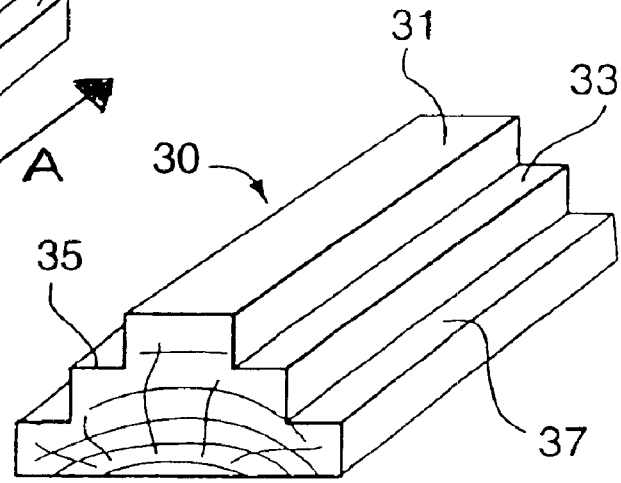
FIG. 3 is a perspective view of another converted elongated wood article having one planar face and two stepped faces.

Referring to FIG. 3, in another converted elongated wood article 30 is formed from elongated wood piece 31 having rectangular steps 37 on longitudinally extending stepped face 33 and stepped face 35. Stepped face 35 replaces planar face 26 from the converted elongated wood article of FIG. 2.

Figure 4A:
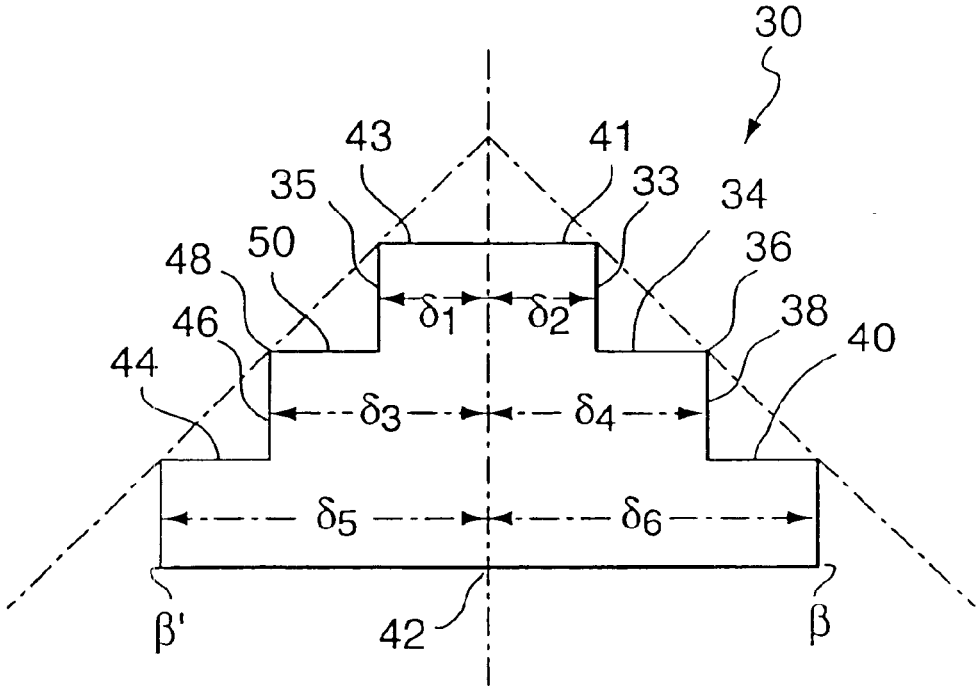
FIG. 4A is a cross-sectional view of a portion of the converted elongated wood article in FIG. 3.

Referring to FIG. 4A, converted elongated wood article 30 is shown having stepped faces 33 and 35, and planar face 42. Stepped face 33 is formed from rectangular steps 40 with each of rectangular steps 40 having edge 34 and edge 38 which intersect at substantially right angle corner 36. Stepped face 35 is similarly formed from rectangular steps 44 each having edges 46 and 50 intersecting at substantially right angle corner 48. Each of rectangular steps 40 and each of steps 44 after first steps 41 and 43 are successively offset from bisecting line 42. Accordingly, stepped faces 33 and 35 are arranged so that distances $\delta_1$, $\delta_3$, and $\delta_5$ from bisecting line 42 and distances $\delta_2$, $\delta_4$, and $\delta_6$ from bisecting line 42 are successively larger.

In the illustrative embodiment in FIGS. 1 and 2, converted elongated wood article 10 is formed from a log with a 100 mm diameter which has been sectioned into 1 meter long segments. Converted elongated wood article 10 has three rectangular steps on stepped face 20, each step having a height and width of approximately 15 mm. The cross-sectional length of planar faces 22 and 26 are 45 mm each. Converted elongated wood article 30 in FIGS. 3 and 4A is cut from log 55 having a diameter of approximately 100 mm which has been sectioned into 1 meter lengths. Each rectangular step of stepped faces 33 and 35 has a height and width of 15 mm, so that planar face 42 has a length of approximately 90 mm. The above dimensions are illustrative of some of the typical converted elongated wood articles contemplated in the present invention. It will be understood, however, that the length, height and width of converted elongated wood articles and the dimensions and number of steps will vary for selected applications. The type of wood source and dimensions of the wood source will also vary.

The converted elongated wood articles in FIGS. 1 to 4B may be used to form a large variety of composite wood products, as indicated, by way of example, in FIGS. 5 to 11.

Figure 5:
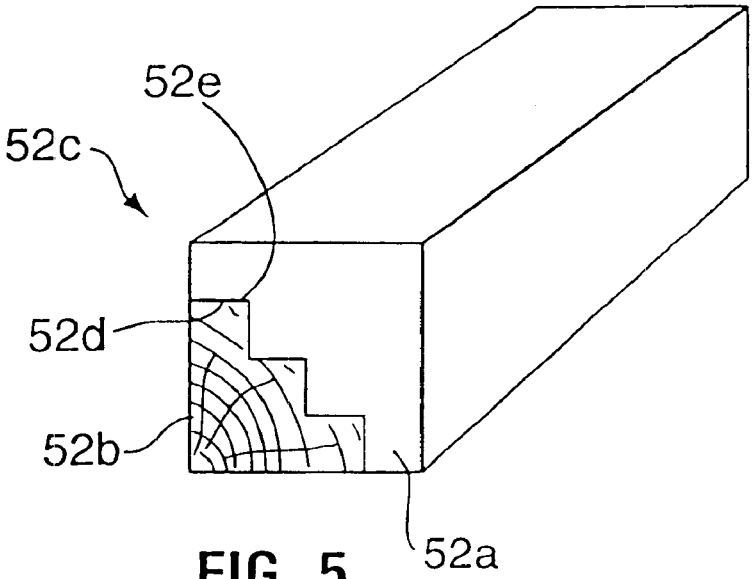
FIG. 5 is a perspective view of a composite wood product comprising converted elongated wood articles.

Referring to FIG. 5, converted elongated wood articles 52*a* and 52*b* are arranged to form composite wood product 52*c*. Stepped faces 52*d* and 52*e* of converted elongated wood articles 52*a* and 52*b* respectively are oriented inwardly and mate with each other so that composite wood product 52*c* has a rectangular cross-sectional outline.

Figure 6:
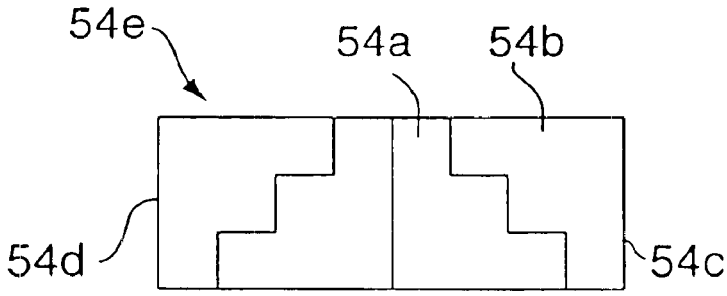
FIG. 6 is a cross-sectional view of another composite wood product comprising converted elongated wood articles.
Figure 4B:
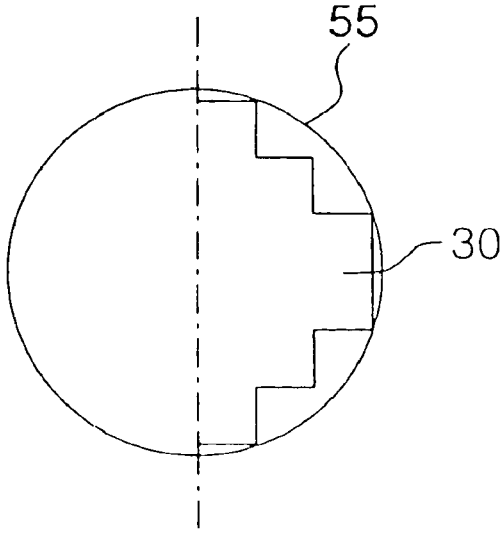
FIG. 4B is a cross-sectional view of a log and a converted elongated wood article cut therefrom.

Referring to FIG. 6, converted elongated wood articles 54*a* and 54*b* are arranged to form composite wood product 54*c* which in turn is attached to second composite wood product 54*d* to form composite wood product 54*e*. Additional composite wood products (not shown) may be attached to form larger composite wood products.

Figure 7B:
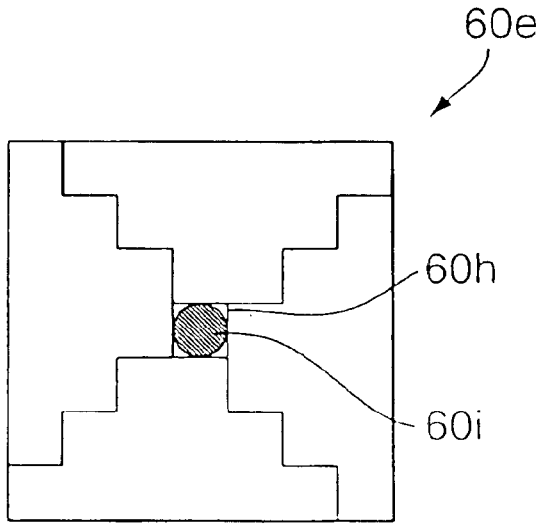
FIG. 7B is a cross-sectional view of another composite wood product.
Figure 7A:
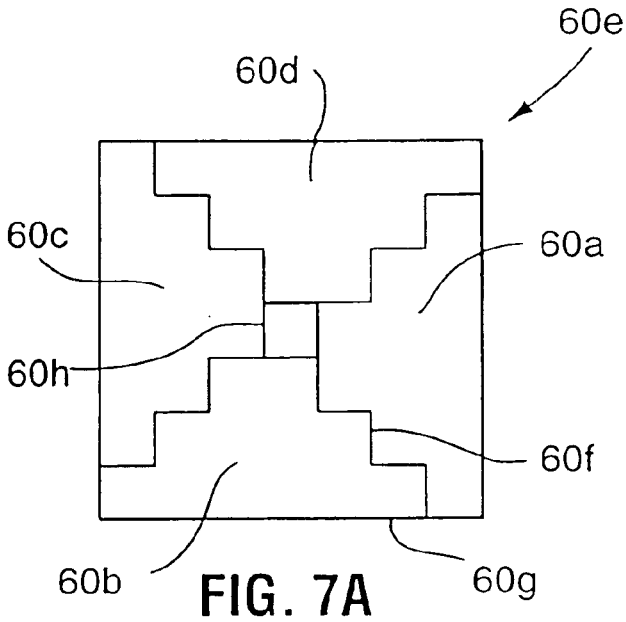
FIG. 7A is a cross-sectional view of another composite wood product.

Referring to FIG. 7A, the cross-section of another composite wood product 60*e* is shown comprising converted elongated wood articles 60*a,* 60*b,* 60*c,* and 60*d* which are of substantially similar dimension. Stepped faces 60*f* on each of converted elongated wood articles 60*a* to 60*d* are oriented to face inwardly within composite wood product 60*e* so as to abut corresponding stepped faces of neighboring converted elongated wood articles forming hollow rectangular interior 60*h* and substantially rectangular cross-sectional outline 60*g*. Referring to FIG. 7B, composite wood product 60*e* is shown having reinforcing rod 60*i* fixed within hollow rectangular interior 60*h* to provide enhanced load bearing capacity.

Figure 8:
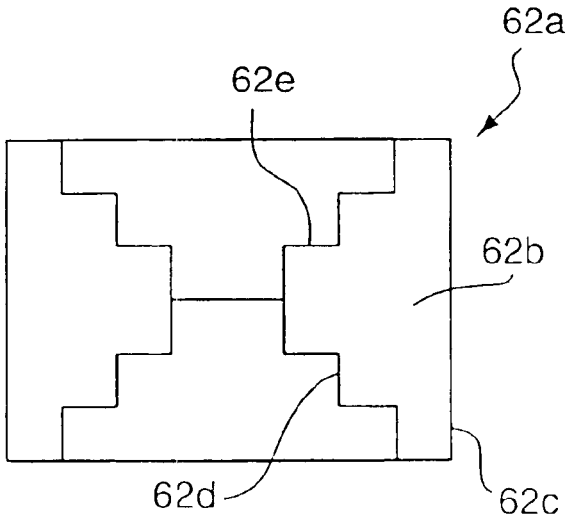
FIG. 8 is a cross-sectional view of yet another composite wood product comprising an arrangement of converted elongated wood articles.

Referring to FIG. 8, another composite wood product 62*a* is shown having rectangular cross section 62*c* and comprising converted elongated wood articles 62*b* each having stepped faces 62*d* and 62*e*.

Figure 9:
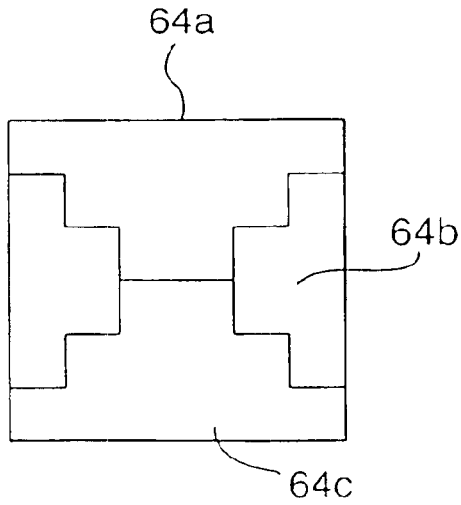
FIG. 9 is a cross-sectional view of yet another composite wood product.

Referring to FIG. 9, yet another composite wood product 64*a* is shown comprising two different sets of converted elongated wood articles contemplated herein, namely converted elongated wood articles 64*b* and converted elongated wood articles 64*c*.

Figure 10:
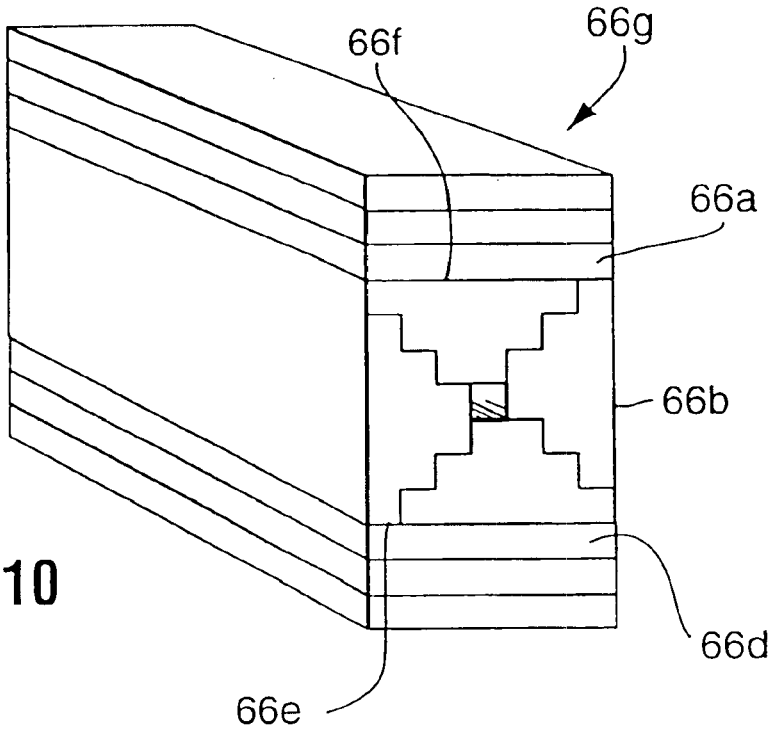
FIG. 10 is a perspective view of a composite wood product used in conjunction with other wood boards.

Referring to FIG. 10, composite wood product 66*b* is shown located between wood boards 66*a* and wood boards 66*d* which in combination form composite wood product 66*g*. Wood boards 66*a* and 66*d* are shown attached to faces 66*e* and 66*f* of composite wood product 66*b*.

Figure 11:
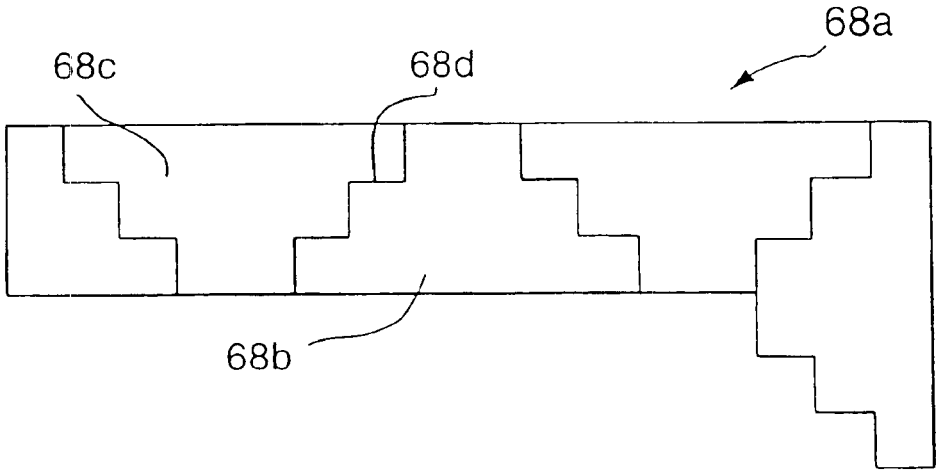
FIG. 11 is a cross-sectional view of another composite wood product under this invention.

Referring to FIG. 11, composite wood product 68*a* has converted elongated wood articles 68*b* and converted elongated wood articles 68*c* inversely arranged and joined along stepped faces 68*d*. As with the other composite wood products, the number of rectangular steps on any face of converted elongated wood articles 68*b* and 68*c* will vary with the selected application.

Figure 12:
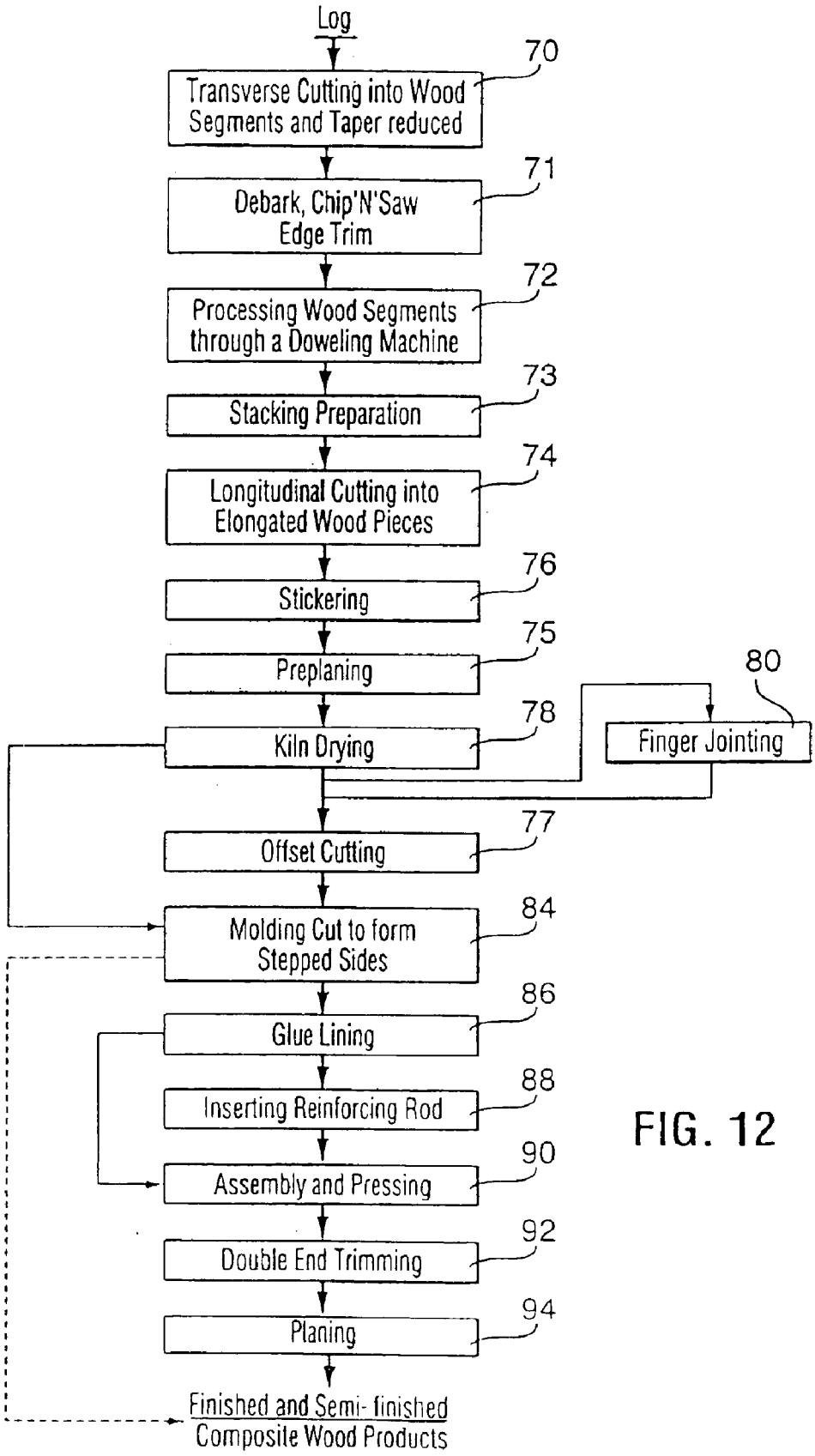
FIG. 12 is a flow diagram for the method of making converted elongated wood articles and composite wood products.

Referring to FIG. 12, one method of manufacturing the converted elongated wood articles and composite wood products made therefrom is shown. Typically elongated wood logs are used as the initial input product to be processed. At step 70 the taper of the wood product is reduced by a cutter that cuts the swollen root end down and the wood is then cut transversely into wood segments which vary in length with the desired finished or semifinished product. In one preferable embodiment, the wood segments are cut substantially into 1 meter lengths to minimize warping when kiln drying at step 78. Other segment lengths may apply depending on the drying effect of the species and the desired application. The resulting wood segments from step 70 are processed at steps 71 where they are debarked and edge trimmed and at step 72 the segments are put through a doweling machine and then undergo stacking preparation at step 73. The stacked segments are then each cut longitudinally into elongated wood pieces at step 74. The wood pieces undergo stickering at step 76, preplaning at step 75 and are then kiln dried at step 78.

The kiln dried wood pieces from step 78 are given an offset cut at step 77 and then a molding cut at step 84 to form converted elongated wood articles of the type described above having either one or more stepped faces. Alternatively, the kiln dried wood pieces from step 78 may be finger jointed at step 80, and then given an offset cut at step 77 before undergoing the molding cut at step 84. One may also use precomposed wood products, typically laminated or solid wood boards, or wood pieces cut from solid wood boards having a wane along one or more edges in step 84 as an alternative to the kiln dried wood pieces from step 78.

The converted elongated wood articles produced at step 84 may be packaged and shipped for subsequent use in assembling the composite wood products described herein.

Alternatively, the converted elongated wood articles may then undergo glue lining at step 86. Glue lining includes the application of bonding material to the surfaces of the stepped face of each converted elongated wood article. The amount and choice of bonding material applied at step 86 to the converted elongated wood articles may vary with the selected application of the final composite wood product. Preferably, the glue lining at step 86 includes application of bonding material to most or substantially all surfaces of each stepped face of the converted elongated wood article. Converted elongated wood articles are also assembled with corresponding converted wood articles in step 86 to form the composite wood products described above.

Once the converted elongated wood articles have undergone glue lining and assembly at step 86 the resulting composite wood products are assembled with other corresponding wood articles and pressed at step 90. Composite wood products from step 90 are double end trimmed at step 92 and planed to final desired dimensions at step 94, resulting in semifinished or finished composite wood products. Before undergoing pressing at step 90, composite wood products from step 86 which are arranged having a hollow interior, such as in FIG. 7B, may first have a reinforcing rod inserted into the hollow interior at step 88 to provide additional load bearing capacity and resistance to shearing and impact forces. Wood boards may also be glued and pressed to the faces of the composite wood product at step 90.

The converted elongated wood articles described herein offer substantially improved surface area on stepped faces for the application of bonding material. The stepped face or faces on each converted elongated wood article further allows for easy assembly with corresponding converted wood articles to form a wide range of composite wood products. The composite wood products formed from the converted elongated wood articles provide significant improvements in resistance to shearing and impact forces and improved load bearing capacity. The composite wood products further avoid many of the complex reinforcing requirements of the prior art. In addition, the significant resistance to shearing and impact forces achieved in the composite wood products above permits the use of wood pieces from old growth and stagnant growth timber as well as younger generation timber for a much broader application of use in the lumber industry. The composite wood products are well suited for use in making flooring, paneling, support beams, and posts, and are also well suited as substitutes to the conventional use of solid wood pieces in the construction of homes and other buildings. The scope of application for smaller wood pieces provided by the converted wood articles further results in less wood waste.

It will be obvious to one skilled in the art that while the converted elongated wood articles have one or more stepped faces, the number of steps on any stepped face will vary as required by the desired composite wood product. It will be further obvious that it is not necessary for the steps on any stepped face to lie on a notional straight line. It will be further obvious that the dimensions of each step on a stepped face need not be the same. It will be further obvious that while a reinforcing rod may be inserted during assembly of composite wood products having a hollow interior, any reinforcing material may be inserted.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A converted elongated wood article comprising: a first planar face and a longitudinally extending face with rectangular steps whose step surface are parallel to a longitudinal extension of said converted elongated wood article, a first set of said step surfaces parallel to, and a second set of said step surfaces perpendicular to said first planar face, with said rectangular steps extending from said first planar face to a second planar face coinciding with a parallel one of said first set of step surfaces, and a third face oriented such that said first planar, said longitudinally extending, said second planar face and said third face for a triangular cross-section, said converted wood article having a solid body and forming an elongated structural construction component when bonded to one or more identical converted elongated wood articles;

wherein said third face is a longitudinally extending face having rectangular steps whose step surfaces are parallel to a longitudinal extension of said converted elongated wood article and having a first set of said step surfaces parallel to, and a second set of said step surfaces perpendicular to, said first planar face.

2. A converted elongated wood article according to claim 1, wherein said third face is a planar face at a right angle to said first planar face.

3. A converted wood article according to claim 1, wherein planes passing through extremities of said rectangular steps each form an equal angle with said longitudinally extending face.

4. A converted elongated wood article according to claim 1, wherein said rectangular steps each have equal dimensions.

5. A converted elongated wood article according to claim 1, wherein the number of said rectangular steps on said longitudinally extending face is at least three.

6. A converted elongated wood article according to claim 1, where the number of rectangular steps on said longitudinally face is at least three.

7. A converted elongated wood article according to claim 1, wherein the number of said rectangular steps on said longitudinally extending face and said third face is equal and at least three.

8. A converted elongated wood article according to claim 1, wherein an extremity of each of said rectangular steps lies along a plane that does not pass through and converted elongated wood article.

9. A composite wood product made up of a plurality of the converted elongated wood articles according to claim 1.

10. A composite wood product according to claim 9, wherein each said converted wood article is an elongated beam.

11. A composite wood product according to claim 9, wherein each rectangular step of each said converted wood article has substantially similar dimensions to every other of said rectangular steps.

12. A composite wood product comprising a plurality of the converted elongated wood articles according to claim 2.

13. A composite wood product according to claim 12, wherein said composite wood product has a rectangular cross-section.

14. A composite wood product according to claim 13, wherein each said converted elongated wood article is an elongated beam.

15. A composite wood product comprising four of the converted elongated wood articles according to claim 1.

16. A composite wood product according to claim 15, wherein said composite wood product has a rectangular cross-section.

17. A composite wood product according to claim 16, further comprising a hollow interior space along a longitudinal direction of said composite wood product.

18. A composite wood product according to claim 17, including reinforcing material fixed within said hollow interior space of said composite wood product.

19. A method of fabricating a composite wood product comprising: gluing together at least two converted elongated wood articles, each said converted wood article having a first planar face and a longitudinally extending face with rectangular steps having step surfaces that are parallel to, and a second set of said step surfaces perpendicular to, said first planar face, said steps extending from said first planar face to a second planar face coinciding with a parallel on of said first set of step surfaces, and a third face oriented such that said first planar, said longitudinally extending, second planar and third faces form a triangular cross-section, wherein the step of one of said converted elongated wood articles are joined in mating abutment to the steps of another identical one of said converted elongated wood articles having a solid body and forming a joint.

20. A method according to claim 19, wherein said third face of each said converted elongated wood article is a longitudinally extending face with rectangular steps whose step surfaces are parallel to a longitudinal extension of said converted elongated wood article and having a first set of said step surfaces parallel to, and a second set of said step surfaces perpendicular to, said first planar face.

21. A method according to claim 19, wherein said third face of each of said converted elongated wood article is a planar face at a right angle to said first planar face.

22. A method according to claim 19, wherein the composite wood product is rectangular in cross-section.

23. A method according to claim 19, including kiln drying wood pieces before shaping such wood pieces into said converted elongated wood articles so as to remove moisture from said wood pieces.

24. A method according to claim 23, including cutting said wood pieces transversely to form wood pieces having substantially one meter lengths.

25. A method according to claim 19, wherein said composite wood product has a hollow interior space.

26. A method according to claim 25, including inserting a reinforcing rod in said hollow interior space.

27. A method of fabricating, from a log, a converted elongated wood article comprising: forming a first planar face and a longitudinally extending face with rectangular steps whose step surfaces are parallel to a longitudinal extension of said converted elongated wood article, and a first set of said step surfaces parallel to, and a second set of said step surfaces perpendicular to, said first planar face, and forming a second planar face parallel to said first planar face and extending said steps from said first planar face to said second planar face such that said second planar face and said steps are proximate a periphery of said log and said first planar face lies along a diameter of said log forming a third face oriented such that said first planar, said longitudinally extending second planar and third faces form a triangular cross-section, said converted wood article having a solid body and forming an elongated structural construction component when bonded to one or more identical converted elongated wood articles.

28. A method according to claim 27, further including establishing said triangular cross-section such that at least two vertices of said triangular cross-section are located outside of an exterior surface of said log and at least two steps have edges on the exterior surface of said log.

* * * * *